United States Patent [19]

Todd

[11] 3,983,727

[45] Oct. 5, 1976

[54] RADIOGRAPHICALLY SECURE COMBINATION LOCK

[75] Inventor: Orin H. Todd, Washington, D.C.

[73] Assignee: The United States of America as represented by the Secretary of the Army, Washington, D.C.

[22] Filed: July 7, 1975

[21] Appl. No.: 593,553

[52] U.S. Cl. ..... 70/323

[51] Int. Cl.[2] ..... E05B 15/14

[58] Field of Search ..... 70/321, 322, 323, 324, 70/327, 328, 333 R, 334

[56] References Cited

UNITED STATES PATENTS

| | | | |
|---|---|---|---|
| 1,191,638 | 7/1916 | Whitmarsh | 70/305 |
| 1,847,071 | 3/1932 | Doenges | 70/322 |
| 1,928,853 | 10/1933 | Doenges | 70/323 |
| 2,016,487 | 10/1935 | Doenges | 70/323 |
| 2,856,765 | 10/1958 | Sreb | 70/333 |
| 3,473,354 | 10/1969 | Hutchins | 70/312 |

*Primary Examiner*—K. Downey
*Assistant Examiner*—Al Craig, Jr.
*Attorney, Agent, or Firm*—Witherspoon and Lane

[57] ABSTRACT

A wheel pack and fence utilized to form a radiographically secure combination lock are disclosed. The wheel pack includes three or more wheels. Each wheel of the wheel pack has a plurality of gates formed in the wheel. Half of the plurality of gates on each wheel are cut halfway through on one side and the other half of the plurality of gates are cut halfway through the other side. The gates are cut in the shape of right triangles and are so positioned that the hypotenuse of each triangular gate on one side of a wheel intersects the hypotenuse of a triangular gate on the other side of that wheel. The fence which must drop into a gate of each wheel to withdraw the lock bolt is designed to contact only one-half of each wheel of the wheel pack. The fence is shaped to fit into a triangular gate of each wheel that is identical in shape and orientation to the fence. There is only one gate on each wheel that matches the fence and therefore there is only one true gate on each wheel. All the rest of the gates are false gates. However, since all the gates, whether true or false, have a mirror image gate immediately behind them they all look the same on a flat X-ray plate or to a counter recording the strength of a gamma neutron source.

10 Claims, 3 Drawing Figures

RADIOGRAPHICALLY SECURE COMBINATION LOCK

The invention described herein may be manufactured, used, and licensed by or for the Government for Governmental purposes without the payment to me of any royalties thereon.

BACKGROUND OF THE INVENTION

This invention relates to combination locks, and more particularly to a wheel pack and fence used in a conventional combination lock to render the combination lock radiographically secure.

Locks of the type commonly referred to as combination locks are of course well known. Generally such locks depend for their operation upon the alignment of a plurality of elements in a preselected manner which permits the operation of a bolt. These elements are usually in the form of discs commonly called wheels or tumblers, each of which is provided with a notch or recess called a gate. Such locks are generally provided with a wheel pack containing three such wheels each having a gate. However, more than three wheels can be provided. The gate of each of the wheels utilized must be properly aligned before the bolt can be moved. The security of such prior art locks depends mainly upon the fact that number of orders or permutations of the possible relative positions of each wheel before all gates are brought into registry is so large that the chance of these gates being aligned by a person not familiar with the combination is very small. However, relatively modern technology has made it possible to determine the combination to such prior art combination locks.

X-ray photography techniques will provide a flat photograph of the wheel pack that shows the position of the gate on each wheel. With this information one skilled in the art can readily operate the lock. In addition to X-ray techniques neutron beam gauging techniques will also reveal the combination. In such gauging techniques, a columnated neutron beam from, for example, a gamma neutron source, is aimed at the edge of the wheel pack and the location of a gate is indicated on a counting device by a higher count for a set time period. This higher count results from less metal or nylon being in the beam path when the beam passes through a gate.

Prior art combination locks that resist attack by the foregoing mentioned techniques have, of course, been developed. Some of these prior art locks use additional false wheels or tumblers, still others use gate shields and others use a plurality of gates only one of which is a true gate. Most of these prior art locks do provide a combination lock that resists attack by X-ray photography; however, some of these prior art locks are vulnerable to neutron gauging attack. Further, with many of these prior art locks a highly skilled person can utilize X-ray photography or neutron gauging to determine the combination. This task is exceedingly difficult to accomplish with some of the prior art locks but can be accomplished.

This invention provides a wheel-pack and fence for a conventional combination lock that converts the lock to a radiographically secure lock. With the wheel pack of this invention it is virtually impossible to determine the combination of the lock by X-ray photography technique or by neutron gauging techniques. Each wheel of the wheel pack of this invention contains a plurality of gates only one of which is a true gate. While this basic technique has been utilized in some prior art locks, the true-false gates of each wheel of the wheel pack of this invention are so formed and shaped that this invention provides an improvement over the prior art true-false gate devices.

SUMMARY OF THE INVENTION

This invention provides a wheel pack and fence that can be utilized in a conventional combination lock to convert the lock to a radiographically secure lock. The wheel pack of this invention includes a plurality of wheels, usually three are provided although more can be utilized. Each wheel contains a plurality of gates only one of which is a true gate. One-half of the gates on each wheel are cut halfway through one side of the wheel and the other half of the gates are cut halfway through the other side of the wheel. All the gates are cut in the shape of a right triangle and are so positioned around the edge of each wheel that the hypotenuse of a triangle on one side of each wheel intersects the hypotenuse of a triangle on the other side of that wheel.

The fence of the lock which must drop into a gate on each wheel to withdraw the lock bolt is designed to only contact one-half of each wheel and is shaped such that it will only fit into a gate identical in shape and orientation to the fence. There is only one gate on each wheel that meets this requirement. Thus, there is only one true gate on each wheel. The rest of the gates on each wheel are false gates. However, since all the gates, whether true or false, have a mirror image gate immediately behind them, they all look the same on a flat X-ray plate or to a counter recording the strength of a gamma neutron source. Thus, while it is possible to locate all the true-false gates of a wheel pack of this invention, it is impossible to distinguish the true gates from the false gates using X-ray or neutron gauging techniques.

BRIEF DESCRIPTION OF THE DRAWING

The exact nature and structural details of the invention will be apparent from the following detailed description when read in conjunction with the annexed drawing in which.

DETAILED DESCRIPTION OF THE INVENTION

Figure 1:
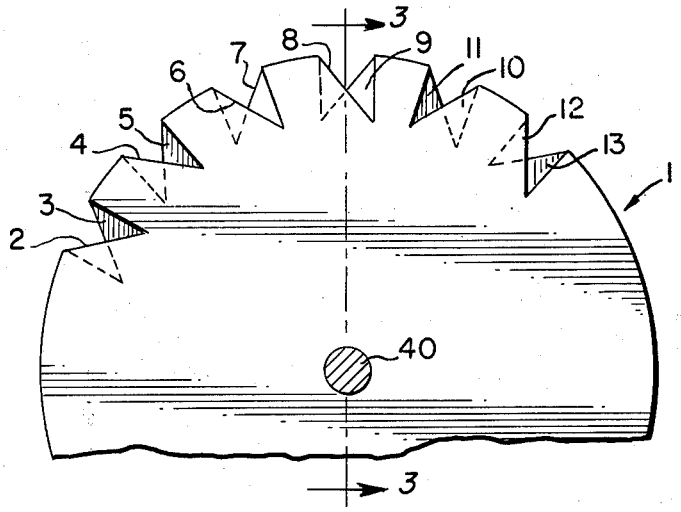
FIG. 1 is a plan view of a part of a combination lock wheel constructed in accordance with this invention.

Since the wheels, wheel pack and fence of this invention are designed to be directly interchangeable with the wheels, wheel pack and fence of any conventional combination lock utilizing a wheel pack and fence, for example, a Sargent and Greenleaf T-8400 series lock, none of the Figures of the drawing show a wheel or the wheel pack and fence of this invention actually incorporated in a combination lock. Such locks and the structural details of such locks are, of course, well known in the art. All that is required is that the wheel pack and fence of this invention be made of identical or nearly identical size to the wheel pack and fence of the lock for which they are to be substituted. This, of course, should be obvious since the wheel pack and fence must obviously fit in the lock in which they are to be used and must interfit with the balance of the lock components. The significant aspects of this invention are the design and construction of the gates and the design of the fence. These features are fully illustrated in the drawing.

Referring to FIG. 1, this Figure shows part of a combination lock wheel 1 of this invention. Wheel 1 is of course a complete circular disc only part of which is illustrated in FIG. 1. In FIG. 1, wheel 1 is shown as having the 12 gates 2, 3, 4, 5, 6, 7, 8, 9, 10, 11, 12, and 13 cut into the edge thereof. While wheel 1 is shown as having only 12 gates, in practice, wheel 1 preferably has a plurality of gates uniformly spaced around its entire circumference. However, as will be apparent, gates do not have to be provided around the entire circumference, but as stated, it is preferable to provide gates around the entire circumference. Further, no specific number of gates is required. However, as will become apparent, a relatively large number of gates is preferred over a small number.

Figure 2:
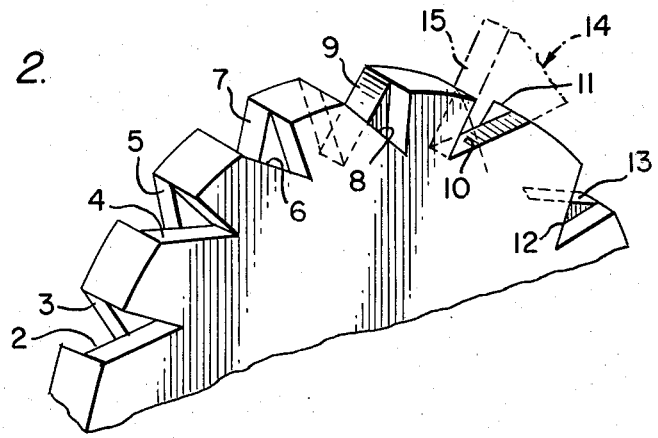
FIG. 2 is a perspective view of part of a combination lock wheel showing the gate configuration of this invention.

As shown in FIGS. 1 and 2, gates 2 through 13 are actually gate pairs 2–3, 4–5, 6–7, 8–9, 10–11 and 12–13. Gates 2 through 13 are cut in the shape of right triangles with gates 2, 4, 6, 8, 10 and 12 being cut halfway through the front of wheel 1 as oriented in FIGS. 1 and 2 and gates 3, 5, 7, 9, 11 and 13 are cut half through the back of wheel 1. Also, as is shown in FIGS. 1 and 2, the gates cut in the front and back half are so positioned relative to each other to form gate pairs, as mentioned above, with the hypotenuse of the triangle of a gate on one side intersecting the hypotenuse of the triangle of a gate on the other side. While, as mentioned, the specific number of gates is not critical, it is obvious that the total number of gates will always be an even number since the gates in the back and front form gate pairs.

In FIGS. 1 and 2, only one of the gates is a true gate, the rest are false gates. Specifically, gate 10 is the true gate. Gates 2 through 9 and 11 through 13 are false gates. The hypotenuse of gate 10 going from the edge of wheel 1 inward slants toward the left in FIGS. 1 and 2, whereas the hypotenuse of each of the other front triangular gates 2, 4, 6, 8 and 12 going from the edge of wheel 1 inward slants to the right. The hypotenuse of the triangle of each of the gates 3, 5, 7, 9, 11 and 13 all slant in the opposite direction from the hypotenuse of the triangle of gates 2, 4, 6, 8, 10 and 12 respectively. Thus, each of the gates has a mirror image gate behind it.

The fact that gate 10 is the only true gate is clearly shown in FIG. 2 which also shows part of the leg 15 of the fence 14 (FIG. 3) of this invention. As shown in FIG. 2, leg 15 of fence 14 is so dimensioned and positioned that it will only contact one-half of wheel 1, the front half in FIG. 2. Leg 15 is also so shaped that it matches gate 10 and will therefore fit into only gate 10. Leg 15 is blocked from dropping into any of the gates except gate 10 by hypotenuse of the triangle of the gates 2, 4, 6, 8 and 12. This fact cannot, however, be detected by X-ray photography or by neutron beam gauging.

As mentioned above and as is obvious from FIGS. 1 and 2, each gate has a mirror image behind it. Thus, all the gates, whether true or false, will all look the same on a flat X-ray plate. Similarly, neutron gauging techniques will not distinguish between the true and false gates constructed in the manner shown in FIGS. 1 and 2. Neutron gauging involves the aiming of a columnated neutron beam from, for example, a gamma neutron source at the edge of the wheels of a combination lock wheel pack. With such a system, the location of a gate is indicated by a higher count for a set time period. The higher count results from less metal or nylon (combination lock wheels are generally made of metal or nylon) being present in the beam path. With gates 2 through 13, the count will be the same due to the fact that the gates are cut and arranged as mirror image pairs. Thus, while all gates will be located by neutron gauging as they are with X-ray photography, it is impossible to distinguish between the true gate and the false gate since the count is the same for all gates. In the X-ray photograph the gates all look the same.

Figure 3:
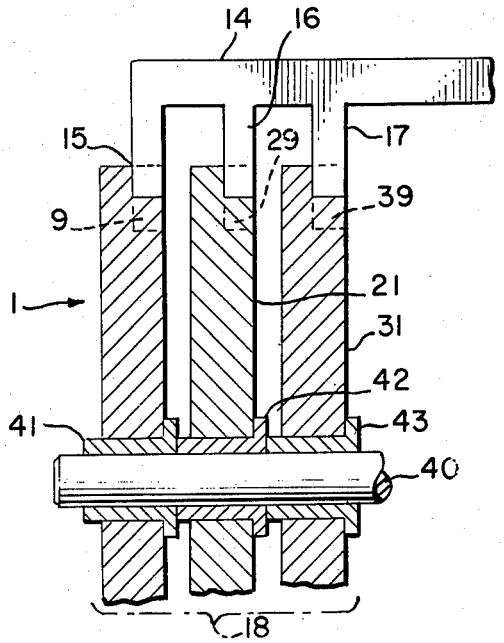
FIG. 3 shows in cross-section a wheel pack constructed in accordance with this invention and shows a fence constructed in accordance with this invention.

In most conventional combination locks three wheels are generally used to make up the wheel pack. Therefore, three wheels having gates such as the gates 2 through 13 of wheel 1, with only one true gate on each wheel will generally be utilized to make up a combination lock wheel pack of this invention. Such a three wheel combination lock wheel pack 18 is shown in FIG. 3. Wheel pack 18 includes wheel 1 and the wheels 21 and 31. Wheels 1, 21 and 31 are shown in cross-section in FIG. 3 with only a part of each wheel being shown. Wheels 1, 21 and 31 are all circular discs. Thus, it is obvious that the balance of each wheel below the axel 40 would appear the same as the upper half of each wheel in FIG. 3. Wheels 21 and 31 each have a plurality of gates identical in structure to the gates 2 through 13 of wheel 1. Of course wheel 1, as previously mentioned and wheels 21 and 31 will preferably each have a plurality of gates spaced uniformly around its entire circumference. Since only a part of each of the wheels 1, 21 and 31 is shown in FIG. 3 and since these wheels are shown in cross-section, only a single gate, the gates 9, 29 and 39 of wheels 1, 21 and 31 respectively, are shown in FIG. 3. Gates 9, 29 and 39 are all false gates. Since gates 9, 29 and 39 are false gates, leg 15 of fence 14 and the legs 16 and 17 of fence 14 cannot fully drop down into gates 9, 29 and 39 respectively. The ends of legs 16 and 17 are shaped identical to the shape of the end of leg 15 as shown in FIG. 2. Of course, due to the manner in which fence 14 is constructed, all of the legs will be held out of a gate until all the true gates are aligned. When the true gate of each of the wheels 1, 21 and 31 are aligned adjacent legs 15, 16 and 17 respectively, fence 14 will drop since legs 15, 16 and 17 can now fully drop into their associated gates.

In conventional combination locks the wheels are generally mounted on an axel or spindle such as axel 40. Also hubs such as the hubs 41, 42 and 43 may be provided. The exact axel and hub arrangement provided is not critical to this invention. Thus, axel 40 and hubs 41, 42 and 43 are given by way of example only. Wheels 1, 21 and 31, except for their gates, will be constructed identical in size and in construction to the wheels of the conventional lock into which wheels 1, 21 and 31 are to be mounted. Thus, except for the gate construction, the construction of a given set of wheels of this invention will be governed by the construction of the combination lock into which wheels 1, 21 and 31 are going to be used. In other words, one set of wheels constructed in accordance with this invention may, except for gate construction, have a different appearance than another set of wheels. Of course all the wheels will be circular discs, but, for example, the hub or center hole through one set of wheels may be different than another set of wheels because the combination locks into which the two sets of wheels are to be used are constructed differently. Similarly, the overall shape of fence 14 may be different for different locks. The shape of the legs will, of course, be the same in all cases. Also, the number of wheels may vary from lock to lock. Generally three wheels are used, but in some locks more than three wheels are utilized. Where more than three wheels are provided, wheel pack 18 would then have more than three wheels all having gates constructed in accordance with this invention and fence 14 would have a number of legs equal to the number of wheels provided with each leg being shaped as described above with reference to legs 15, 16 and 17. Thus, it is apparent that the combination lock wheels of this invention and the fence can be constructed to accommodate any conventional combination lock utiliizing a wheel pack, the shape and arrangement of the gates and the shape of the legs of the fence being the significant features of this invention.

From the foregoing description, it is apparent that this invention provides a combination lock that is radiographically secure. An X-ray photograph of a combination lock utilizing the wheels of this invention will show all the gates on each wheel, but the gates will look alike. Therefore, it is not possible to distinguish the one true gate from all the false gates on a flat X-ray plate. Similarly, due to the construction and arrangement of the gates of this invention, neutron gauging will locate all the gates on a wheel but the count for a true gate will be the same as a count for a false gate, Thus, neutron gauging will not distinguish a true gate from a false gate.

While the invention has been described in detail with reference to a specific embodiment as shown in the drawing, it will be obvious to those skilled in the art that various modifications and changes can be made to the embodiment shown and described without departing from the spirit and scope of the invention as set forth in the claims.

What is claimed is:

1. A tumbler wheel for a radiographically secure combination lock comprising:

a circular disc;

a first plurality of gates cut into the edge of said circular disc halfway through one side of said disc; and a second plurality of gates cut into said edge of said circular disc halfway through the other side of said circular disc, said first and second plurality of gates being so positioned relative to each other that each gate of said first plurality of gates forms a gate pair with a different one of said second plurality of gates.

2. A tumbler wheel for a combination lock as defined in claim 1 wherein said first plurality of gates each has the shape of a right triangle and each gate of said second plurality of gates has the shape of a right triangle, the hypotenuse of the triangle of each gate of said first plurality of gates intersecting the hypotenuse of the triangle of a different gate of said second plurality of gates.

3. A tumbler wheel for a radiographically secure combination lock as defined in claim 2 wherein only one gate of said first plurality of gates is a true gate and all the rest of the gates of said first plurality of gates and all of the gates of said second plurality of gates are false gates.

4. A tumbler wheel for a radiographically secure combination lock as defined in claim 3 wherein said first plurality of gates are uniformly spaced around the entire circumference of said circular disc and said second plurality of gates are uniformly spaced around the entire circumference of said circular disc.

5. A radiographically secure combination lock comprising:

a plurality of tumbler wheels each having a first plurality of gates cut into its edge halfway through one side and a second plurality of gates cut into its edge halfway through the other side, said first and second plurality of gates forming mirror image gate pairs.

6. A radiographically secure combination lock as defined in claim 5 wherein each gate of said first plurality of gates of each said tumbler wheel and each gate of said second plurality of gates of each said tumbler wheel is cut in the shape of a right triangle, the hypotenuse of the triangle of each gate of said first plurality of gates intersecting the hypotenuse of the triangle of a different gate of said second plurality of gates.

7. A radiographically secure combination lock as defined in claim 6 wherein only one gate of said first and second plurality of gates on each of said plurality of wheels is a true gate and all other said gates are false gates.

8. A radiographically secure combination lock as defined in claim 7 wherein a fence designed to fit into only said true gate of each of said plurality of wheels is operatively associated with said plurality of wheels.

9. A radiographically secure combination lock as defined in claim 8 wherein said fence has a plurality of legs equal in number to the number of said plurality of tumbler wheels and is so operatively positioned relative to said plurality of tumbler wheels that each leg of said fence is operatively associated with a different one of said plurality of tumbler wheels, each leg of said plurality of legs being so dimensioned and positioned that it will contact only one half of its associated tumbler wheel and so shaped that it will fit into only the true gate of its associated wheel.

10. A radiographically secure combination lock as defined in claim 9 wherein the number of said plurality of tumbler wheels is three.

* * * * *